US011774999B2

(12) United States Patent
Gao et al.

(10) Patent No.: US 11,774,999 B2
(45) Date of Patent: Oct. 3, 2023

(54) VOLTAGE REFERENCE GENERATION WITH COMPENSATION FOR TEMPERATURE VARIATION

(71) Applicant: NXP USA, INC., Austin, TX (US)

(72) Inventors: Yuan Gao, Cugnaux (FR); Simon Brule, Toulouse (FR); Estelle Huynh, Villeneuve-Tolosane (FR)

(73) Assignee: NXP USA, Inc., Austin, TX (US)

( * ) Notice: Subject to any disclaimer, the term of this patent is extended or adjusted under 35 U.S.C. 154(b) by 299 days.

(21) Appl. No.: 17/038,773

(22) Filed: Sep. 30, 2020

(65) Prior Publication Data

US 2021/0124386 A1 Apr. 29, 2021

(30) Foreign Application Priority Data

Oct. 24, 2019 (EP) ..... 19306379

(51) Int. Cl.
*G05F 3/26* (2006.01)

(52) U.S. Cl.
CPC ..... *G05F 3/262* (2013.01)

(58) Field of Classification Search
CPC ... G05F 3/185; G05F 3/18; G05F 3/20; G05F 3/245; G05F 3/26; G05F 3/267; G05F 3/262; G05F 3/22; G05F 3/222; G05F 3/225; G05F 3/00–30; G01R 19/32; H01L 9/866; H03K 3/38
USPC ..... 327/541
See application file for complete search history.

(56) References Cited

U.S. PATENT DOCUMENTS 3,456,564 A * 7/1969 McCandless ..... B31B 50/741 493/158
3,624,493 A * 11/1971 Gately ..... G05F 1/56 323/277
3,743,923 A * 7/1973 Steudel ..... G05F 3/185 330/69

(Continued)

FOREIGN PATENT DOCUMENTS

CN 10 9343642 * 2/2019
EP 0220789 * 9/1985

(Continued)

OTHER PUBLICATIONS

Non-Final Office Action for U.S. Appl. No. 16/286,758 dated Nov. 25, 2020, 18 pages.

(Continued)

*Primary Examiner* — Thienvu V Tran
*Assistant Examiner* — Nusrat Quddus

(57) ABSTRACT

In a particular example, a low drift voltage reference system includes a Zener diode circuit, a voltage reduction circuit, and a proportional-to-absolute temperature (PTAT) circuit. The Zener diode circuit, which is coupled between a first supply terminal (e.g., $V_{DD}$) and a second supply terminal (e.g., common), provides an input reference voltage level. The voltage reduction circuit provides another reduced version of the input reference voltage level. The PTAT circuit has first and second differential paths to provide an output reference voltage at an output node of the PTAT circuit, and a feedback path to draw feedback current from the output node to control the differential circuit.

12 Claims, 3 Drawing Sheets

(56) References Cited

U.S. PATENT DOCUMENTS 4,074,181 A * 2/1978 Crowle ..... G05F 3/18 330/307
4,093,907 A * 6/1978 Nutz ..... G05F 3/18 327/535
4,283,674 A 8/1981 Kominami et al.
4,313,083 A * 1/1982 Gilbert ..... G05F 1/567 327/535
4,315,209 A 2/1982 Schmoock
4,352,056 A 9/1982 Cave et al.
4,398,142 A * 8/1983 Beasom ..... H01L 27/0664 323/907
4,605,891 A * 8/1986 Wrathall ..... G05F 1/573 330/257
4,665,356 A * 5/1987 Pease ..... G05F 3/18 323/354
4,774,452 A * 9/1988 Ahmed ..... G05F 3/18 323/314
5,039,878 A * 8/1991 Armstrong ..... G01K 3/005 327/512
5,063,342 A * 11/1991 Hughes ..... G01K 3/005 323/317
5,243,239 A * 9/1993 Khan ..... H03K 3/011 327/552
5,252,908 A * 10/1993 Brokaw ..... G05F 1/463 323/907
5,272,392 A * 12/1993 Wong ..... H03K 17/063 327/512
5,300,877 A * 4/1994 Tesch ..... G05F 3/225 327/540
5,446,349 A 8/1995 Bocan et al.
5,559,500 A * 9/1996 Kase ..... H02H 3/087 324/126
5,568,368 A 10/1996 Steigerwald et al.
5,621,307 A * 4/1997 Beggs ..... G05F 3/18 323/907
6,271,605 B1 8/2001 Carkner et al.
6,456,151 B1 * 9/2002 Pontarollo ..... H02M 3/07 327/198
6,661,713 B1 * 12/2003 Kuo ..... G05F 3/30 365/189.11
6,956,727 B1 * 10/2005 Brokaw ..... G01R 19/0023 361/93.7
7,246,416 B2 7/2007 Duffy
7,423,416 B1 9/2008 Quinones et al.
7,426,416 B2 9/2008 Sri-Jayantha et al.
8,149,047 B2 * 4/2012 Tsai ..... H03F 3/345 327/539
8,816,756 B1 * 8/2014 Eberlein ..... G05F 3/30 327/539
9,448,579 B2 9/2016 Marinca
10,281,946 B1 5/2019 Baranwal et al.
10,712,763 B2 * 7/2020 Mouret ..... G05F 3/267
10,802,517 B1 * 10/2020 Assaad ..... G05F 1/468
11,397,445 B1 * 7/2022 Lam ..... H02M 3/04
2002/0079967 A1 * 6/2002 Prentice ..... H03F 3/45085 330/254
2003/0137287 A1 * 7/2003 Marie ..... G05F 3/267 323/314
2004/0004992 A1 * 1/2004 Aota ..... G01K 7/01 374/163
2004/0056645 A1 * 3/2004 Inagaki ..... G05F 3/242 323/313
2005/0088223 A1 * 4/2005 Morgan ..... G05F 1/56 327/541
2006/0082349 A1 * 4/2006 Peron ..... G01R 19/175 323/235
2006/0104001 A1 * 5/2006 Yoshio ..... H02H 3/085 361/103
2006/0145750 A1 * 7/2006 Geller ..... G05F 3/18 327/538
2007/0046363 A1 * 3/2007 Tanzawa ..... G05F 3/30 327/539
2007/0052405 A1 * 3/2007 Mochizuki ..... G05F 3/30 323/316
2007/0252573 A1 11/2007 Tachibana et al.
2009/0059623 A1 3/2009 Cai
2009/0284304 A1 * 11/2009 Conte ..... G05F 3/30 327/539
2010/0176886 A1 * 7/2010 Feng ..... G05F 1/575 331/15
2011/0074495 A1 3/2011 Duval et al.
2012/0019322 A1 * 1/2012 Silva ..... H03F 3/24 323/280
2012/0081099 A1 * 4/2012 Melanson ..... G05F 3/30 323/313
2012/0092064 A1 * 4/2012 Floyd ..... G05F 3/242 327/543
2013/0241526 A1 * 9/2013 Ozasa ..... G05F 3/222 323/314
2014/0152290 A1 * 6/2014 Huang ..... G05F 3/30 323/314
2014/0159699 A1 * 6/2014 Iguchi ..... G05F 3/30 323/313
2014/0247034 A1 * 9/2014 Lok ..... G05F 3/02 323/313
2014/0266139 A1 * 9/2014 Eberlein ..... G05F 3/20 323/313
2015/0054487 A1 * 2/2015 Kochkin ..... G05F 3/16 323/314
2015/0102856 A1 4/2015 Barrett, Jr. et al.
2015/0177771 A1 6/2015 Marinca
2015/0227156 A1 * 8/2015 Kobayashi ..... G05F 3/16 323/268
2016/0197095 A1 * 7/2016 Yamane ..... H01L 29/73 257/506
2016/0266598 A1 * 9/2016 Wong ..... G05F 3/267
2016/0327972 A1 * 11/2016 Ippolito ..... G05F 3/267
2017/0168518 A1 * 6/2017 Rasmus ..... G05F 3/245
2017/0178734 A1 * 6/2017 Pasotti ..... G11C 16/10
2018/0159317 A1 * 6/2018 Mirabella ..... H03K 19/0027
2018/0181151 A1 * 6/2018 Xu ..... G05F 1/56
2018/0210480 A1 * 7/2018 Sone ..... G05F 3/267
2019/0317542 A1 10/2019 Brule
2020/0081475 A1 * 3/2020 Marinca ..... G05F 3/20
2020/0183434 A1 * 6/2020 Hurwitz ..... G05F 3/30
2020/0192414 A1 * 6/2020 Mouret ..... G05F 3/267
2020/0218302 A1 * 7/2020 Brule ..... G05F 3/18
2020/0301462 A1 * 9/2020 Sicard ..... G05F 3/30
2020/0333821 A1 * 10/2020 Tomonaga ..... G05F 3/16
2021/0034092 A1 * 2/2021 Tomioka ..... G05F 3/185
2021/0303012 A1 * 9/2021 Yuk ..... G05F 1/575
2021/0389791 A1 * 12/2021 Liu ..... G05F 3/18
2021/0397210 A1 * 12/2021 Mallard ..... G05F 3/30
2022/0050488 A1 * 2/2022 Randlisek ..... G05F 3/30

FOREIGN PATENT DOCUMENTS

EP 3553625 A1 * 10/2019 ..... G05F 3/18
EP 3926437 A1 * 12/2021 ..... G05F 3/18
GB 1401745 12/1975
JP H05100757 A 4/1993
WO 1993/004423 3/1993

OTHER PUBLICATIONS

Notice of Allowance for U.S. Appl. No. 16/286,758 dated Feb. 10, 2021, 8 pages.
Pryce, Dave, "EDN Special Report—Voltage References," No. 2, Jan. 13, 1990, pp. 120-126, and 128.
U.S. Appl. No. 16/286,758, filed Feb. 27, 2019.
Non-Final Office Action for U.S. Appl. No. 16/286,758 dated Jul. 10, 2019, 14 pages.
Non-Final Office Action for U.S. Appl. No. 16/286,758 dated Oct. 18, 2019, 10 pages.
U.S. Appl. No. 16/394,634, filed Apr. 25, 2019.
Hood, John L. Linsley, "LM109 three-terinal voltage regulator," Wireless World, vol. 88, No. 1554, Mar. 1, 1982, pp. 41-44.

(56) References Cited

OTHER PUBLICATIONS

Final Office Action for U.S. Appl. No. 16/286,758 dated Dec. 5, 2019, 18 pages.
Ex parte Quayle Office Action for U.S. Appl. No. 16/286,758 dated Feb. 6, 2020, 13 pages.
Non-Final Office Action for U.S. Appl. No. 16/286,758 dated Jun. 11, 2020, 8 pages.
Non-Final Office Action for U.S. Appl. No. 16/394,634, dated Jan. 10, 2020, 36 pages.
Notice of Allowance for U.S. Appl. No. 16/394,634, dated Jun. 19, 2020, 17 pages.

* cited by examiner

VOLTAGE REFERENCE GENERATION WITH COMPENSATION FOR TEMPERATURE VARIATION

OVERVIEW

This disclosure relates generally to semiconductor devices, and more specifically, to Zener-diode voltage reference circuitry in semiconductor devices.

In semiconductor devices, providing a stable reference voltage via a voltage generator on an integrated circuit (IC) is important. For example, such circuits benefiting from provision of a stable reference voltage are used in connection with, among others, data conversion, analog processing devices, electronic sensors, and many digital and/or mixed signal applications. Many of these circuit types use voltage generators that are specified to be stable over manufacturing process variations, supply voltage variations, and operating (and extended) temperature variations. Such voltage generators can be implemented without modifications of conventional manufacturing processes and while many improvements in these regards have been realized, voltage generator circuits continue to be benefited by improvements in terms of the above-noted issues as well as other circuit design issues such as component count, packaging stresses, speed/power efficiencies and IC space.

These and other matters have presented challenges to accuracies of implementations involving Zener-based voltage reference circuits, for a variety of applications.

SUMMARY

Various example embodiments are directed to issues such as those addressed above and/or others which may become apparent from the following disclosure concerning a voltage reference circuit to provide a reference voltage derived from or based on a Zener diode circuit. In certain specific example embodiments, aspects of the present disclosure involve compensation for voltage drift due to circuit components being influenced, for example, by changes in temperature.

In a particular example embodiment, an apparatus includes a Zener diode circuit, a voltage reduction circuit, and a proportional-to-absolute temperature (PTAT) circuit. The Zener diode circuit is coupled between a first supply terminal ($V_{DD}$) and a second supply terminal (common) and is to provide an input reference voltage level. The voltage reduction circuit is to provide a reduced level of the input reference voltage level. The PTAT circuit includes a differential circuit having first and second differential paths to provide an output drive current and an output reference voltage at an output node of the PTAT circuit, having a feedback path from the output node to control the differential circuit.

In one or more example embodiments, the voltage reduction circuit may include a voltage divider circuit having a first resistive circuit connected to a first input node and a second resistive circuit connected to the first input node.

In one or more example embodiments, one of the first and second differential paths may include a transistor circuit to pass current between the first supply terminal and the second supply terminal, the transistor circuit having a control terminal driven in response to the other input reference voltage level.

In one or more example embodiments, one of the first and second differential paths may include a transistor circuit to pass current between the first supply terminal and the second supply terminal, the transistor circuit having a control terminal driven in response to the output reference voltage at the output node.

In one or more example embodiments, one of the first and second differential paths may include one transistor circuit to pass current between the first supply terminal and the second supply terminal, the transistor circuit may be configured to receive a control signal driven in response to the other input reference voltage level and to generate a drive signal to provide control to the feedback path, and another of the first and second differential paths may include another transistor circuit to pass current between the first supply terminal and the second supply terminal, the other transistor circuit having a control terminal driven in response to the output reference voltage at the output node.

In one or more example embodiments, the apparatus may further include a current mirror circuit having first and second legs respectively coupled to the first and second differential paths.

In one or more example embodiments, the Zener diode circuit may be configured to provide a Zener voltage at one node of the Zener diode circuit and the voltage reduction circuit may include a first resistor connected to a second resistor at a resistor-connection node at which the other input reference voltage level is provided, and the first resistor may be also connected to the one node of the Zener diode circuit.

In one or more example embodiments, the Zener diode circuit and the voltage reduction circuit may be arranged in parallel.

In one or more example embodiments, the PTAT circuit may be configured to provide temperature compensation without use of an output buffer.

In one or more example embodiments, the PTAT circuit may further include an output transistor circuit having one node to drive the output node, having another node to close a current loop to one of the first and second supply terminals, and having a control node driven in response to the drive signal which is to provide control to the feedback path.

In one or more example embodiments, the apparatus may further include an analog to digital conversion circuit having an analog input, having a digital output and having a supply voltage terminal to be driven in response to the output reference voltage at the output node.

In one or more example embodiments, one of the first and second differential paths may include a transistor circuit to pass current between the first supply terminal and the second supply terminal, the transistor circuit having a control terminal driven in response to the other input reference voltage level.

In one or more example embodiments, the apparatus may further include a current mirror circuit having first and second legs respectively coupled to the first and second differential paths.

In another specific example embodiment, an apparatus includes a Zener diode coupled between a first supply terminal ($V_{DD}$) and a second supply terminal (common) and provides an input reference voltage level. The apparatus also includes a voltage divider circuit to provide at a first input node, a reduced input reference voltage level that tracks the input reference voltage level; and includes a differential circuit to provide an output drive current and an output reference voltage at an output node. The differential circuit includes a feedback circuit including a feedback path from the output node to control the differential circuit; a first differential path to drive current between the first supply terminal and the second supply terminal based on the reduced input reference voltage level and to provide control for the feedback path, and a second differential path drive current between the first supply terminal and the second supply terminal based on the feedback path.

In one or more example embodiments, the apparatus may further include an analog to digital conversion circuit having an analog input, having a digital output and having a supply voltage terminal connected to the output node for receiving the output reference voltage.

In one or more example embodiments, one of the first and second differential paths may include a transistor circuit to pass current between the first supply terminal and the second supply terminal, the transistor circuit having a control terminal driven in response to the other input reference voltage level.

In yet another specific example, an embodiment is directed to a method for use with the above type of circuit-based apparatus wherein the circuit-based apparatus includes a Zener diode circuit, coupled between a first supply terminal ($V_{DD}$) and a second supply terminal (common), to provide an input reference voltage level. The method includes using a voltage reduction circuit to provide another input reference that tracks the input reference voltage level provided by the Zener diode circuit. Also, the method discloses providing: an output drive current and an output reference voltage at an output node of a proportional-to-absolute temperature (PTAT) circuit which includes a differential circuit having first and second differential paths; and drawing a feedback current from the output node in a feedback path to control the differential circuit.

In one or more example embodiments, one of the first and second differential paths may include a transistor circuit including a control terminal, and another of the first and second differential paths may include another transistor circuit including a control terminal, the method may further include: using the transistor circuit to pass current between the first supply terminal and the second supply terminal; using the transistor circuit to receive a control signal driven in response to the other input reference voltage level and to generate a drive signal to provide control to a feedback path; using the other transistor circuit to pass current between the first supply terminal and the second supply terminal; and driving the control terminal in response to the output reference voltage at the output node.

In one or more example embodiments, the method may further provide temperature compensation without use of an output buffer.

In one or more example embodiments, one of the first and second differential paths may include a transistor circuit including a control terminal, and the method may further include:

using the transistor circuit to pass current between the first supply terminal and the second supply terminal; and driving the control terminal in response to the other input reference voltage level.

In one or more example embodiments, one of the first and second differential paths may include a transistor circuit including a control terminal, and the method may further include:

using the transistor circuit to pass current between the first supply terminal and the second supply terminal; and driving the control terminal in response to the output reference voltage at the output node.

In one or more example embodiments, one of the first and second differential paths may include a transistor circuit including a control terminal, and another of the first and second differential paths may include another transistor circuit including a control terminal, the method may further include: using the transistor circuit to pass current between the first supply terminal and the second supply terminal; using the transistor circuit to receive a control signal driven in response to the other input reference voltage level and to generate a drive signal to provide control to a feedback path; using the other transistor circuit to pass current between the first supply terminal and the second supply terminal; and driving the control terminal in response to the output reference voltage at the output node.

In one or more example embodiments, the method may further include a current mirror circuit having first and second legs respectively coupled to the first and second differential paths.

The above discussion/summary is not intended to describe each embodiment or every implementation of the present disclosure. The figures and detailed description that follow also exemplify various embodiments.

BRIEF DESCRIPTION OF FIGURES

Various example embodiments may be more completely understood in consideration of the following detailed description in connection with the accompanying drawings, in which.

Figure 1:
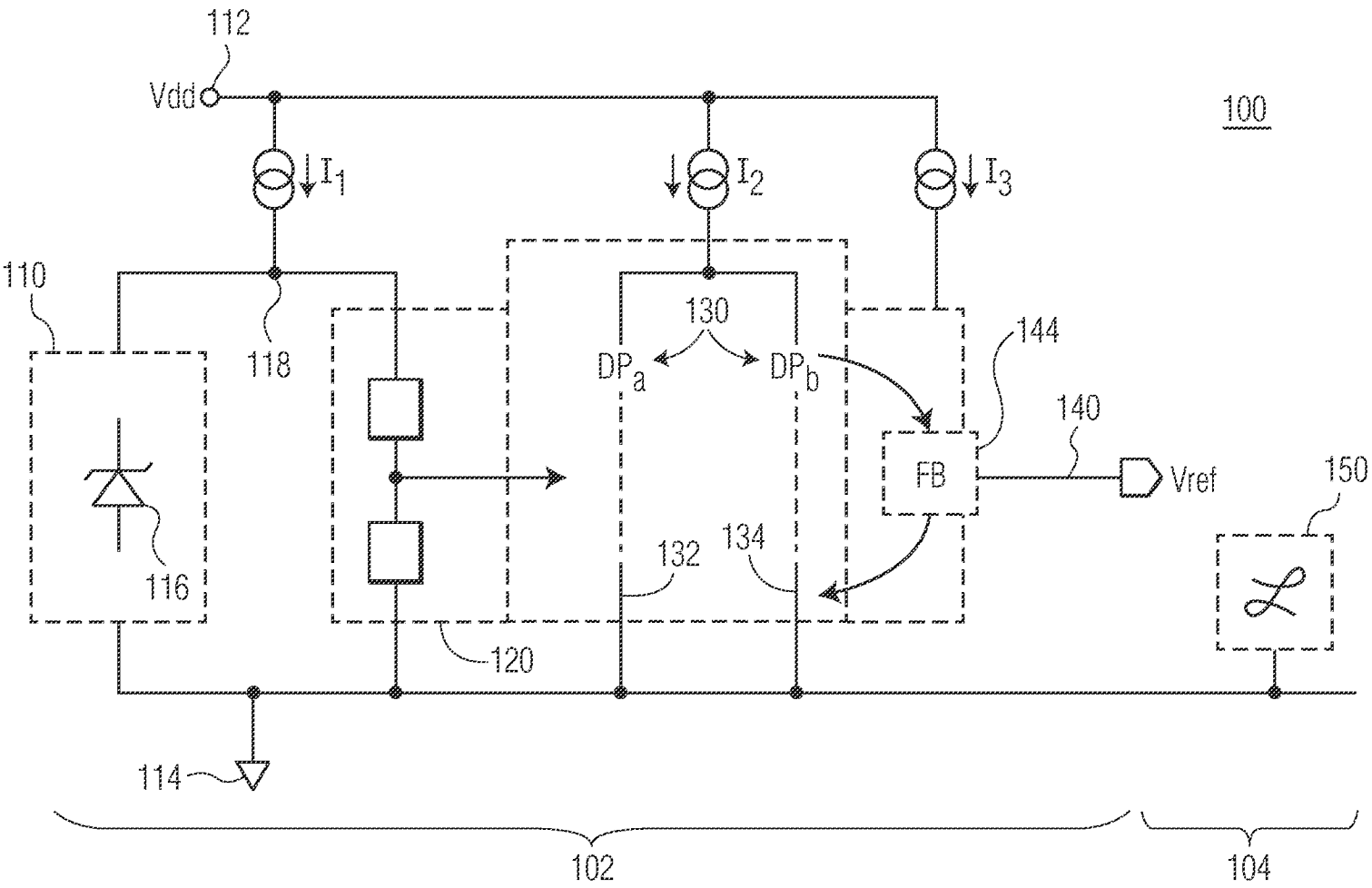
FIG. 1 is a system-level diagram illustrating an example circuit providing a voltage reference, in accordance with the present disclosure.

While various embodiments discussed herein are amenable to modifications and alternative forms, aspects thereof have been shown by way of example in the drawings and will be described in detail. It should be understood, however, that the intention is not to limit the disclosure to the particular embodiments described. On the contrary, the intention is to cover all modifications, equivalents, and alternatives falling within the scope of the disclosure including aspects defined in the claims. In addition, the term "example" as used throughout this application is only by way of illustration, and not limitation.

DETAILED DESCRIPTION

Aspects of the present disclosure are believed to be applicable to a variety of different types of apparatuses, systems and methods involving voltage reference circuits using Zener diodes as an initial reference voltage. In certain implementations, aspects of the present disclosure have been shown to be beneficial when used in the context of controlling voltage drift due to circuit components being influenced, for example, by changes in temperature. While not necessarily so limited, various aspects may be appreciated through the following discussion of non-limiting examples which use exemplary contexts.

Accordingly, in the following description various specific details are set forth to describe specific examples presented herein. It should be apparent to one skilled in the art, however, that one or more other examples and/or variations of these examples may be practiced without all the specific details given below. In other instances, well known features have not been described in detail so as not to obscure the description of the examples herein. For ease of illustration, the same reference numerals may be used in different diagrams to refer to the same elements or additional instances of the same element. Also, although aspects and features may in some cases be described in individual figures, it will be appreciated that features from one figure or embodiment can be combined with features of another figure or embodiment even though the combination is not explicitly shown or explicitly described as a combination. More specific aspects of the disclosure are directed to voltage reference circuitry which includes a Zener diode, or a Zener diode circuit, and which is implemented as part of a semiconductor integrated circuit (IC) that generates a substantially constant reference voltage over an extended temperature range (e.g., −40 to 150° C.). The Zener diode circuit is coupled to a voltage reduction circuit so that both circuits are arranged to drive a proportional to absolute temperature (PTAT) circuit. The PTAT circuit is to generate a reference voltage output based on a bias current and on feedback from the reference voltage output. The PTAT circuit provides compensation for the Zener diode by injecting current for the reference voltage output using the feedback to adjust differential current paths within the PTAT circuit.

In certain more specific examples, the above type of embodiments are implemented with the injected current and feedback serving to stabilize the reference voltage provided by the Zener diode and to realize minimal offset drift and minimization of circuitry at the reference voltage output which may be used for driving the load (or application-specific circuit). In this regard, the reference voltage output may be used as a highly-regulated operating supply voltage (e.g., $V_{DD}$) and, which in some instances, may provide for significant improvement in terms of the linearity of the reference voltage output over the extended temperature range.

As a further more specific example, one such circuit-based apparatus includes a Zener diode circuit, coupled between a first supply terminal ($V_{DD}$) and ground (or common). The Zener diode circuit includes a Zener diode having one terminal coupled to ground and another terminal providing an input reference voltage level connecting to a voltage reduction circuit. The voltage reduction circuit is used to track the input reference voltage level but at a reduced voltage level in order to drive one leg of a differential circuit in a PTAT circuit. This leg and a complementary leg of the differential circuit are used to provide an output reference voltage at an output node of the PTAT circuit. Feedback between the PTAT circuit and output node permit for the output node to maintain a highly-regulated operating supply voltage which may be used for targeted circuitry having a specific application. For example, the targeted circuitry may be an analog-digital converter (ADC) circuit (e.g., successive approximation register (SAR) or sigma delta type) including a first input coupled to receive an analog input voltage, inputs coupled to receive a voltage reference level from the above-mentioned output node and voltage signal and common. As other examples, instead of an ADC circuit, the application-specific circuit may be another type of circuit benefiting from an input being a stable reference voltage or supply voltage. Also, Battery Management System (BMS) products include Zener reference circuits to provide highly-accurate measurements in circuit chains where very low long-term drift is important.

In a more specific embodiment which expands on the preceding more specific example, the legs of the differential circuit are associated with respective first and second differential current paths, each including a transistor which passes current between based on a control signal at its gate or base. The control signal for one transistor receives a signal driven in response to the reduced reference voltage (tracking the Zener diode voltage) and the control signal for the transistor in the other differential path receives a signal derived or generated from a feedback path connected to the output node.

In a particular example embodiment, an apparatus includes a Zener diode circuit, a voltage reduction circuit, and a PTAT circuit. The Zener diode circuit is coupled between a first supply terminal ($V_{DD}$) and a second supply terminal and is to provide an input reference voltage level. The voltage reduction circuit is to provide another input reference voltage level which tracks the input reference voltage level at the Zener diode. The PTAT circuit includes a differential circuit responding to the voltage reduction circuit and having first and second differential paths to provide an output drive current and an output reference voltage at an output node of the PTAT circuit and further having a feedback path from the output node to control the differential circuit.

Turning now to the illustrations of various examples, FIG. 1 shows a block diagram of an electronic apparatus 100 in accordance with an embodiment of the present disclosure. The apparatus 100 includes voltage reference circuit 102 which provides an input in the form of a stable reference voltage or supply voltage to a load (e.g., application-specific circuit) 104. As each of the embodiments described herein are interrelated with aspects being combinable with one another, the voltage reference circuit 102 may be coupled to provide a reference voltage (VREF) to digital-to-analog conversion circuitry (not shown) in the load or application-specific circuit 104.

The voltage reference circuit 102 includes a Zener diode circuit 110 coupled between a first supply terminal ($V_{DD}$) 112 and a ground (or common) terminal 114. The Zener diode circuit includes a Zener diode 116 which may have one terminal coupled to or connected directly to the common terminal 114 and its upper terminal, at node 118, providing an input reference voltage level connecting to a voltage reduction circuit 120. The voltage reduction circuit 120 is used to track the input reference voltage level via node 118 but at a reduced voltage level in order to drive one leg (DPa) 132 of a differential circuit 130 as part of a proportional-to-absolute temperature (PTAT) circuit including differential circuit 130 and influences from other circuits as described. The leg 132 and a complementary leg 134 of the differential circuit 130 are used to provide an output reference voltage at an output node 140. Feedback circuitry 144 is used between the differential (PTAT) circuit 130 and the output node 140 to permit the output node 140 to maintain a highly-regulated operating supply voltage, which may be used for targeted (load) circuitry 150 having a specific application.

In another specific example, an embodiment is directed to a method for using as apparatus such as illustrated in FIG. 1. The method includes using a voltage reduction circuit to provide another input reference voltage level that tracks the other input reference voltage level, and providing an output drive current and an output reference voltage at an output node of a PTAT circuit which includes a differential circuit having first and second differential paths, and drawing a feedback current from the output node in a feedback path to control the differential circuit.

In another more specific example, the embodiment shown in FIG. 1 is used as to provide a low-drift voltage reference circuit with the Zener diode 110 and voltage divider circuit 120 to provide a reduced input reference voltage level at a first input node. The reduced input reference voltage level drives a differential circuit, with legs 132 and 134, to provide an output drive current and an output reference voltage at the output node 140. The differential circuit includes a feedback circuit 144 coupling feedback from the output node. By driving the differential circuit both with a feedforward signal from the first input node to leg 132 and with feedback from the output node to leg 132, a Zener-based voltage reference circuit with low drift and with relatively few components is realized.

Figure 2:
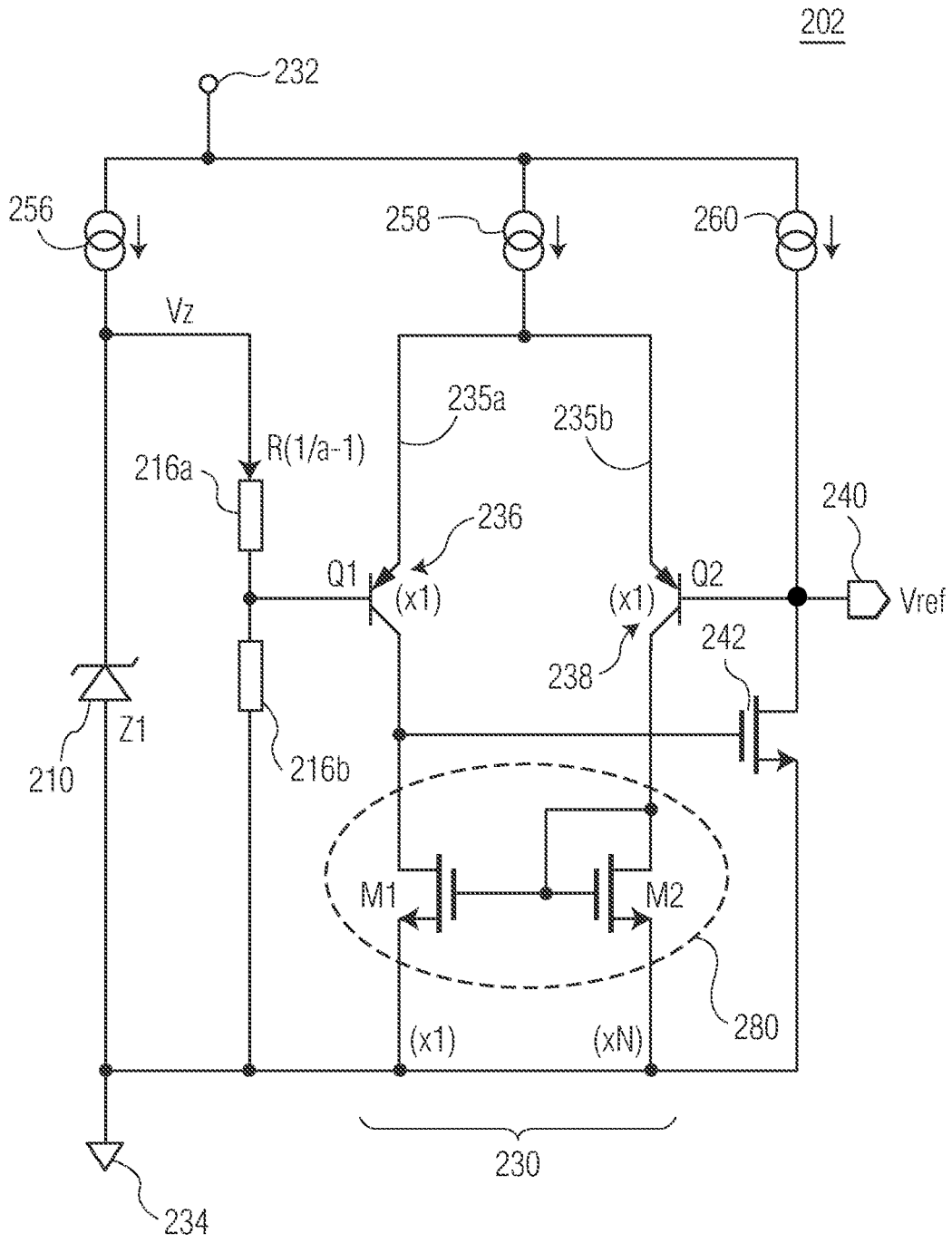
FIG. 2 is another example with a more specific diagram illustrating an exemplary set of circuits for a system of the type implemented in a manner consistent with FIG. 1, in accordance with the present disclosure.

FIG. 2 is a diagram, which more-closely resembles a schematic, of one exemplary way to implement a voltage reference circuit 202. In many but not all regards, the voltage reference circuit 202 is similar to the voltage reference circuit 102 of FIG. 1, as both are in accordance with embodiments of the present disclosure. The voltage reference circuit 202 of FIG. 2 includes a Zener diode 210, a voltage divider as implemented in this example diagram using a pair of resistors 216*a* and 216*b*, and a PTAT (differential) circuit 230. The voltage reference circuit 202 is coupled to a first voltage supply terminal 232 and a second voltage supply terminal (e.g., ground or common) 234. The voltage reference circuit 202 provides a reference voltage VREF at output terminal (e.g., Vref) 240. A nominal operating voltage, which may be $V_{DD}$ in some contexts, is provided at the first voltage supply terminal 232, and a 0-volt (or ground voltage) is provided at the second voltage supply terminal 234. Current sources 256, 258 and 260 are shown providing current from the first voltage supply terminal 232 to, respectively, the Zener diode 210, the PTAT circuit 230 and the output terminal 240.

Within the PTAT circuit 230, one of the differential (legs) paths includes a transistor circuit having a (bipolar) transistor 236 to pass current through the associated leg and with the base of the transistor 236 receiving a control signal driven in response to the voltage referenced from the Zener diode 210. This control signal, provided via the voltage divider 216*a*, 216*b*, plays into the operation of the PTAT circuit 230 by way of a feedforward path from the collector of the transistor 236 (via field-effect transistor (FET) 242) to the output terminal 240. A related control signal is provided via a feedback path derived from the output terminal 240 for controlling the base of complementary (bipolar) transistor 238. The FET 242 effectively closes the circuit for the feedback path provided from the output terminal 240 to the transistor 238. A current-mirror circuit 280, having FETs in the respective first and second legs of the differential paths, returns the current in the differential paths to the terminal 234.

As the Zener diode 210 has a positive temperature coefficient (TC), the PTAT (differential) circuit 230 is used to provide TC compensation which in turn may be used with the other illustrated circuitry in accordance with the present disclosure, to obtain a stable voltage output over a wide temperature range (e.g., from −40° C. to 150° C.). The TC compensation is related to the insensitivity of the fully differential paths 235*a* and 235*b* within the PTAT circuit 230 of FIG. 2. In each path, there is a complementary transistor 236 or 238 to provide for a consistent and opposing TC by ΔVbe (transistor base-emitter voltage) in each of the differential paths 235*a* and 235*b*. With a feedback loop provided, via transistor 242 (e.g., N-type FET), the reference voltage at the output terminal 236 provides excellent control over drift. Moreover, with the output node 240 being biased by a current source 260 connected to the first voltage supply terminal 232, an output buffer is not needed to drive a load; rather, a load may be connected directly to the output node 240 thereby avoiding further power consumption and drift inherently caused by such additional buffer circuitry. Accordingly, certain example embodiments in this regard may be implemented to lessen or minimize drift, current consumption, the component count, and design space or circuit real estate. Such embodiments are also advantageous when used for circuit-based applications in which the load requires highly-accurate reference voltages for safety (e.g., vehicular and industrial applications).

Figure 3:
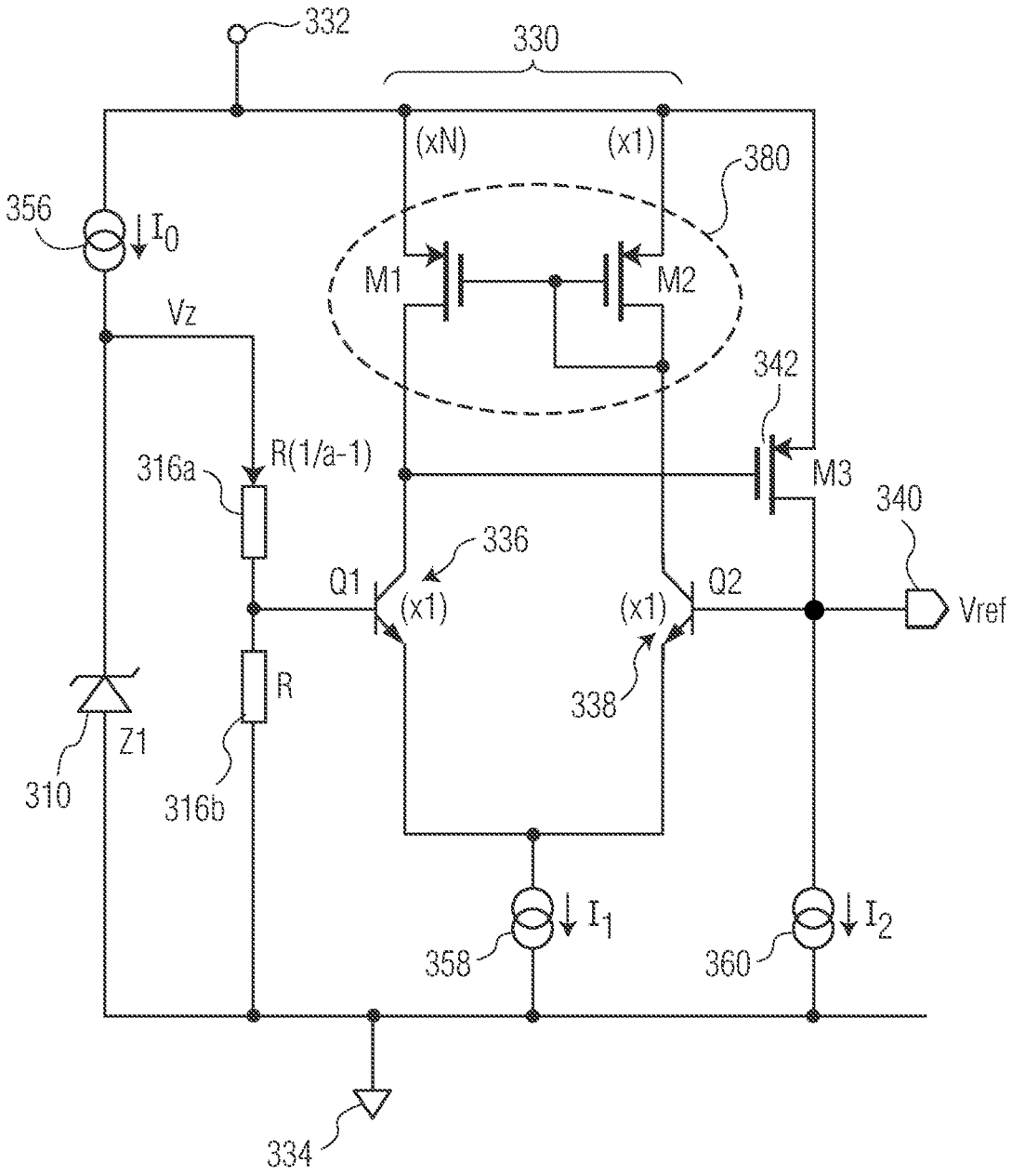
FIG. 3 is another example illustrating an alternative set of circuits for a system of the type implemented in a manner consistent with FIG. 1, also in accordance with the present disclosure.

Further in accordance with the present disclosure, FIG. 3 is yet another example illustrating an alternative to examples of circuit-based apparatuses shown in FIGS. 1 and 2. In this alternative, FIG. 3 shows circuitry related to the circuitry of FIG. 2 but with polarity reversed such as for the transistors including each of the field-effect and bipolar transistors shown in FIG. 2. Related to this reversal of polarity, other differences between FIG. 2 and FIG. 3 include the current sources 258 and 260 of FIG. 2 being replaced by current sinks 358 and 360 (connected to terminal 334) of FIG. 3, and the respective locations on either side of the output terminals 240 and 340 of the FETs 242 and 342. In such contexts and for convenience, related circuits and components between FIG. 2 and FIG. 3 are labeled with corresponding reference numerals such as with the output terminals 240 and 340, with the FETs 242 and 342, and with the PTAT circuits 230 and 330.

In a more specific embodiment for an example application, the circuits and components discussed in connection with FIGS. 2 and 3 may be implemented to provide a desired level or degree of temperature compensation wherein the level or degree is adjusted only by a parameter that concerns a current density ratio such as "N" in the following equation or mathematical relationship. With reference to the output voltage at the output terminals 240 and 340 of FIGS. 2 and 3, this mathematical relationship may be described as:

$$V_{out} = a \cdot V_Z - \Delta Vbe \text{ with } \Delta Vbe = \frac{k \cdot T}{q} \cdot \ln(N)$$

In this mathematical relationship and with reference to the example of FIG. 2 or FIG. 3, $V_z$ refers to the nominal voltage of the Zener diode, "a" or α refers to the ratio of the top-resistor versus the bottom-resistor of the voltage divider for reducing $V_z$. Further, ΔVbe refers to the transistor base-emitter voltage in each of the differential paths (e.g., 235*a* and 235*b* of FIG. 2), k refers to Boltzmann constant, q refers to coulomb's charge, T refers to temperature in ° K, and N refers to the ratio of current density of the two bipolar transistors in the differential paths.

In one such application-specific example relating to the above-described embodiments, Vz is firstly divided using a relatively high impedance to minimize current consumption (e.g., lowering the Zener voltage down to about 1V) and this reduced voltage is then buffered and compensated by the ΔVbe of the transistors (e.g., 236 and 238 of FIG. 2) in the respective legs of the differential paths. By varying the ratio between the opposing transistors in the differential paths (e.g., in FIG. 2, bipolar transistors 236 and 238 or FET-type transistors in the current mirror circuit), the ΔVbe may be adjusted for an appropriate amount of temperature compensation. If more temperature compensation is desired, a PTAT buffer stage may be added.

In a particular example, a low drift voltage reference system includes a Zener diode circuit (110, 116), a voltage reduction circuit (120), and a proportional-to-absolute temperature (PTAT) circuit (130). The Zener diode circuit, which is coupled between a first supply terminal (112) (e.g., VDD) and a second supply terminal (114) (e.g., common), provides an input reference voltage level. The voltage reduction circuit (120) provides another reduced version of the input reference voltage level. The PTAT circuit (130) has first and second differential paths to provide an output reference voltage at an output node (140) of the PTAT circuit, and a feedback path (144) to draw feedback current from the output node to control the differential circuit (130).

The various terminology as used in the Specification (including the claims) connote clear meaning for the skilled artisan. As examples, the Specification describes and/or illustrates aspects useful for implementing the claimed disclosure by way of various circuits or circuitry which may be illustrated as or using terms such as blocks, modules, device, system, unit, controller, component and/or other circuit-type depictions (e.g., reference numerals 110, 120 and 150 of FIG. 1 depict a block/module as described herein). Such circuits or circuitry are used together with other elements to exemplify how certain embodiments may be carried out in the form or structures, steps, functions, operations, activities, etc. For example, in certain of the above-discussed embodiments, one or more modules are discrete logic circuits or IC chips, or IC chip sets configured and arranged for implementing the operations/activities as may be carried out in the approaches shown in FIGS. 1, 2 and 3. In certain embodiments, certain circuitry (e.g., the load circuit 150 of FIG. 1) is or includes a programmable circuit as one or more computer circuits (which may include memory circuitry for storing and accessing a program to be executed as a set (or sets) of instructions (and/or to be used as configuration data to define how the programmable circuit is to perform). As another example, where the Specification may make reference to a "first [type of structure]", a "second [type of structure]", where the [type of structure] might be replaced with terms such as ["circuit", "circuitry" and others], the adjectives "first" and "second" are not used to connote any description of the structure or to provide any substantive meaning; rather, such adjectives are merely used for English-language antecedence to differentiate one such similarly-named structure from another similarly-named structure (e.g., "first circuit configured to convert . . . " is interpreted as "circuit configured to convert . . . ").

Based upon the above discussion and illustrations, those skilled in the art will readily recognize that various modifications and changes may be made to the various embodiments without strictly following the exemplary embodiments and applications illustrated and described herein. For example, methods as exemplified in the Figures may involve steps carried out in various orders, with one or more aspects of the embodiments herein retained, or may involve fewer or more steps.

The invention claimed is:

1. An apparatus comprising:

a Zener diode circuit, coupled between a first supply terminal and a second supply terminal, to provide a first input reference voltage level;

a voltage reduction circuit, arranged in parallel with the Zener diode circuit, to provide a second input reference voltage level that tracks the first input reference voltage level; and a proportional-to-absolute temperature (PTAT) circuit includes a differential circuit having first and second differential paths to provide an output drive current and an output reference voltage at an output node of the PTAT circuit, having a feedforward path to the output node based on the second input reference voltage level, wherein:

the first differential path includes a first transistor circuit to pass current between the first supply terminal and the second supply terminal, the first transistor circuit having a control terminal driven in response to the second input reference voltage level, the second differential path includes a second transistor circuit to pass current between the first supply terminal and the second supply terminal, the second transistor circuit having a control terminal driven in response to the output reference voltage at the output node, and the PTAT circuit is configured to provide a level of temperature compensation that is set by a ratio of current density of the first transistor circuit and the second transistor circuit.

2. The apparatus of claim 1, wherein the voltage reduction circuit includes a voltage divider circuit having a first resistive circuit connected to a first input node and a second resistive circuit connected to the first input node.

3. The apparatus of claim 1, wherein the first transistor circuit is configured to receive a control signal driven in response to the second input reference voltage level and to generate a drive signal to the feedforward path, and wherein the second transistor circuit has a control terminal configured to be driven in response to the output reference voltage at the output node.

4. The apparatus of claim 1, further including a current mirror circuit having first and second legs respectively coupled to the first and second differential paths.

5. The apparatus of claim 1, wherein the Zener diode circuit is to provide a Zener voltage at one node of the Zener diode circuit and wherein the voltage reduction circuit includes a first resistor connected to a second resistor at a resistor-connection node at which the second input reference voltage level is provided, and wherein the first resistor is also connected to the one node of the Zener diode circuit.

6. For use with an apparatus which includes a Zener diode circuit, coupled between a first supply terminal and a second supply terminal, to provide a first input reference voltage level, a method for providing an output drive current and an output reference voltage at an output node of the apparatus, comprising:

using a voltage reduction circuit to provide a second input reference voltage level that tracks the first input reference voltage level;

providing the output drive current and the output reference voltage at an output node of a proportional-to-absolute temperature (PTAT) circuit which includes a differential circuit having first and second differential paths, wherein:

the first differential path includes a first transistor circuit to pass current between the first supply terminal and the second supply terminal, the first transistor circuit having a control terminal driven in response to the second input reference voltage level, and the second differential path includes a second transistor circuit to pass current between the first supply terminal and the second supply terminal, the second transistor circuit having a control terminal driven in response to the output reference voltage at the output node;

providing a feedforward current to the output node based on the second input reference voltage level; and using the PTAT circuit to provide a level of temperature compensation that is set by a ratio of current density of the first transistor circuit and the second transistor circuit.

7. The apparatus of claim 1, wherein the PTAT circuit is to provide temperature compensation without use of an output buffer.

8. The apparatus of claim 1, wherein the PTAT circuit further includes an output transistor circuit having a signal at one node to drive the output node, having another node to close a current loop to one of the first and second supply terminals, and having a control node driven in response to the signal which is provided to the feedforward path.

9. The apparatus of claim 1, further including an analog to digital conversion circuit having an analog input, having a digital output and having a supply voltage terminal to be driven in response to the output reference voltage at the output node.

10. The method of claim 6, wherein the Zener diode circuit and the voltage reduction circuit are arranged in parallel.

11. The method of claim 6, wherein the PTAT circuit is to provide temperature compensation without use of an output buffer.

12. The method of claim 11, further including a current mirror circuit having first and second legs respectively coupled to the first and second differential paths.

* * * * *